US010113551B2

(12) United States Patent
Taroda et al.

(10) Patent No.: US 10,113,551 B2
(45) Date of Patent: Oct. 30, 2018

(54) AXIAL FLOW FAN

(71) Applicant: MINEBEA CO., LTD., Kitasaku-gun, Nagaru (JP)

(72) Inventors: Atsushi Taroda, Kakegawa (JP); Takako Otsuka, Fukuroi (JP); Masaki Ogushi, Nara (JP); Yoichi Kawai, Kitasaku-gun (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 182 days.

(21) Appl. No.: 13/846,414

(22) Filed: Mar. 18, 2013

(65) Prior Publication Data

US 2013/0251559 A1 Sep. 26, 2013

(30) Foreign Application Priority Data

Mar. 23, 2012 (JP) ..... 2012-067879

(51) Int. Cl.
*F04D 25/06* (2006.01)
*F04D 19/00* (2006.01)
*F04D 29/54* (2006.01)

(52) U.S. Cl.
CPC ..... *F04D 25/0693* (2013.01); *F04D 19/002* (2013.01); *F04D 25/0613* (2013.01);
(Continued)

(58) Field of Classification Search
CPC .... F04D 29/601; F04D 29/646; F04D 25/082; F04D 25/0613; F04D 29/403;
(Continued)

(56) References Cited

U.S. PATENT DOCUMENTS 5,088,892 A * 2/1992 Weingold ..... F01D 5/145 415/193
6,431,910 B1 * 8/2002 Chuang et al. ..... 439/577
(Continued)

FOREIGN PATENT DOCUMENTS

JP 2007-009802 A 1/2007
JP B2-4808482 11/2011

OTHER PUBLICATIONS

Jan. 28, 2016 Office Action issued in Japanese Patent Application No. 2012-067897.

*Primary Examiner* — Bryan Lettman
*Assistant Examiner* — Charles W Nichols
(74) *Attorney, Agent, or Firm* — Oliff PLC

(57) ABSTRACT

A axial flow fan includes an impeller having a plurality of blades, a motor arranged to rotate the impeller, and a casing accommodating the impeller and the motor. The casing includes a cylindrical housing, a motor base configured to hold the motor, and a plurality of spokes connecting the housing with the motor base. The plurality of spokes include a spoke having a straight shape and a spoke having a curved shape that is convex toward a rotational direction of the impeller. The axial flow fan further includes a lead wire for supplying electric power to the motor. When a radial length of the spoke having the straight shape is defined as L and an amount of the curvature of the spoke having the curved shape is defined as X, a displacement of the curved shape (X/L) is less than 0.2.

3 Claims, 3 Drawing Sheets

(52) U.S. Cl.
CPC ..... *F04D 29/541* (2013.01); *F04D 29/542* (2013.01); *F04D 29/544* (2013.01)

(58) Field of Classification Search
CPC ..... F04D 29/522; F04D 29/54; F04D 29/541; F04D 29/542; F04D 29/544; F04D 25/06; F04D 25/0606; F04D 25/0693; F04D 25/08; F04D 19/002
See application file for complete search history.

(56) References Cited

U.S. PATENT DOCUMENTS

| | | | | |
|---|---|---|---|---|
| 6,561,762 | B1 * | 5/2003 | Horng et al. | 415/211.2 |
| 7,306,429 | B2 * | 12/2007 | Horng et al. | 415/210.1 |
| 7,780,404 | B2 * | 8/2010 | Horng et al. | 415/191 |
| 2004/0033135 | A1 * | 2/2004 | Chang | F04D 29/703 415/220 |
| 2007/0217149 | A1 * | 9/2007 | Horng et al. | 361/695 |

* cited by examiner

[Fig. 1]
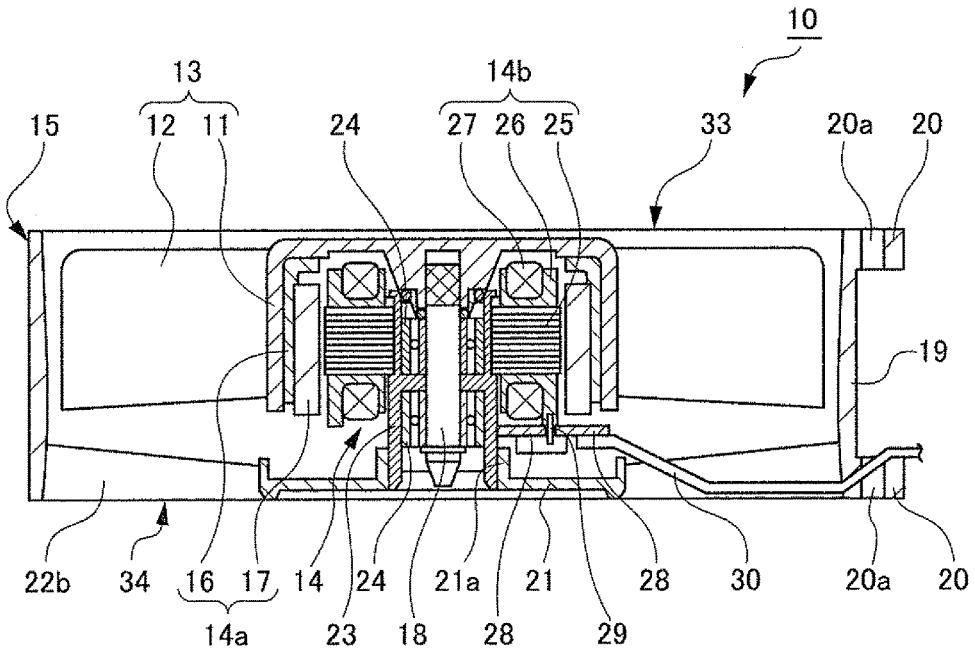
[Fig. 2]
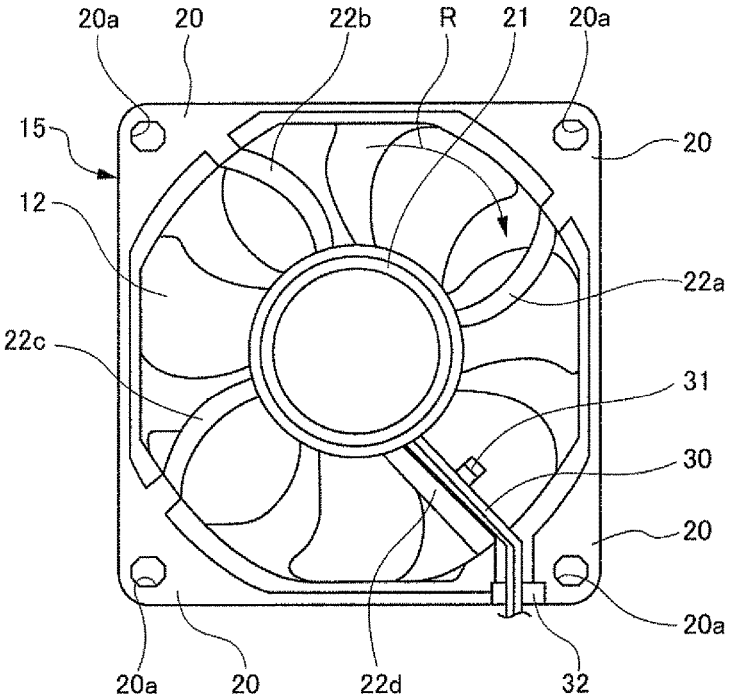

[Fig. 3]
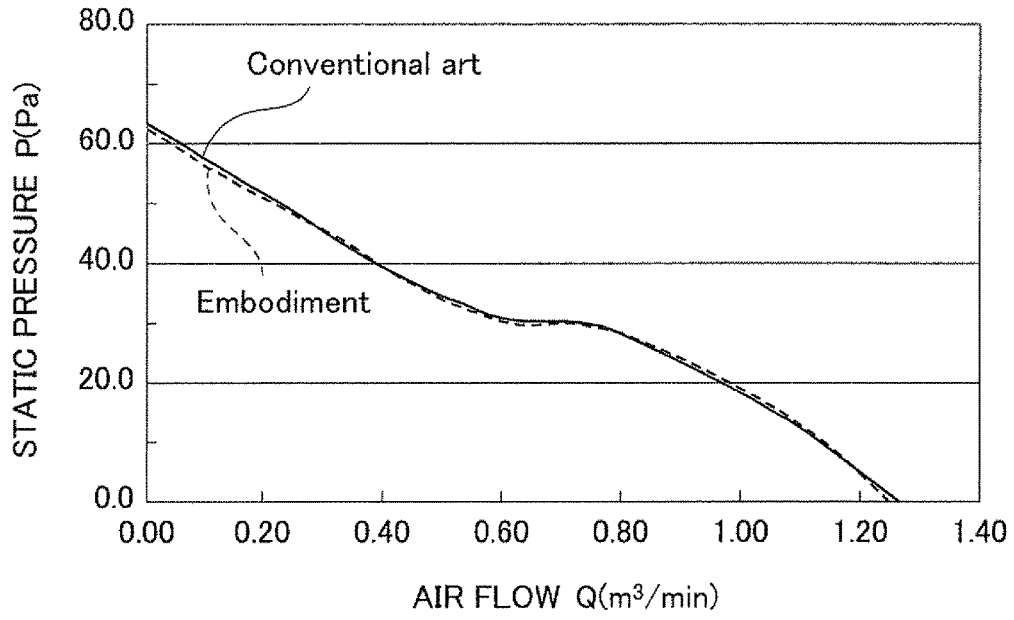
[Fig. 4]
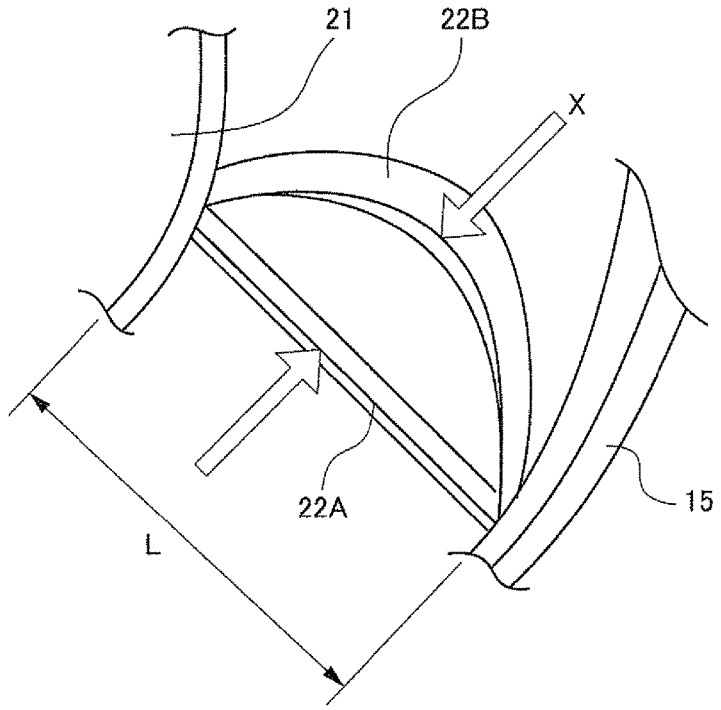

[Fig. 5]
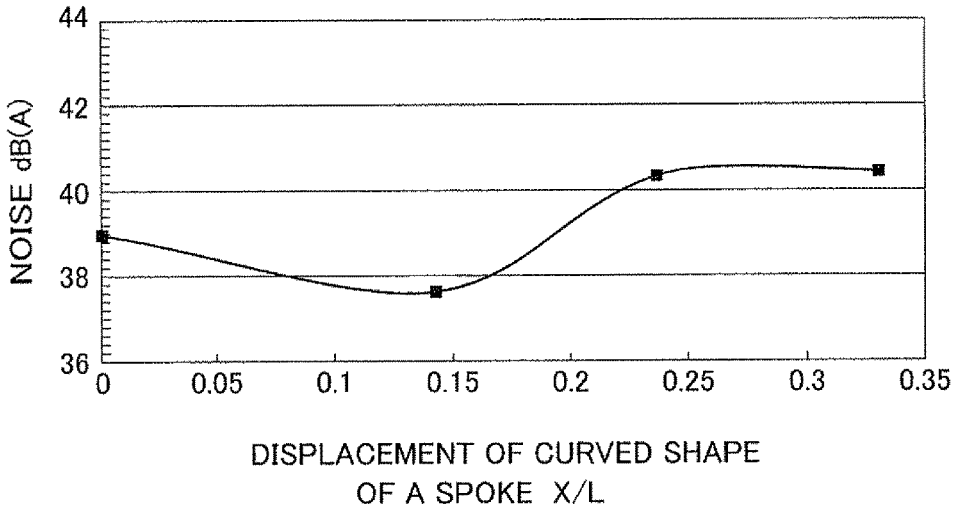
[Fig. 6]
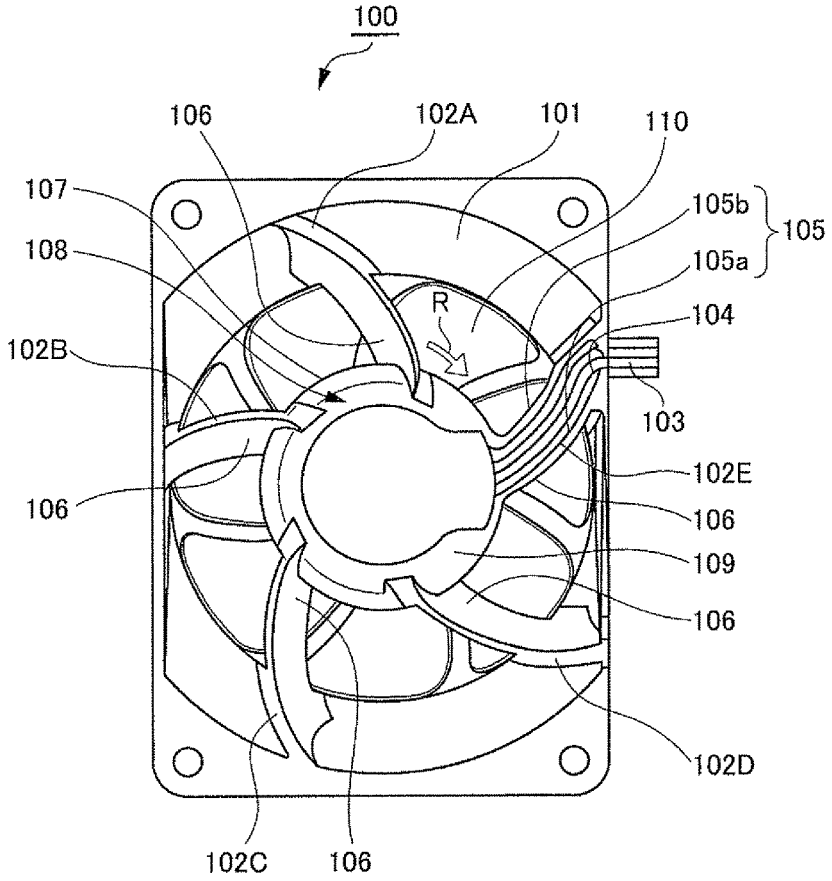

AXIAL FLOW FAN

TECHNICAL FIELD

The present invention relates to an axial flow fan, and in particular, an axial flow fan used for cooling electronic device(s) or the like.

BACKGROUND ART

Generally, in an electronic device such as personal computers, copiers, and the like, many electronic components are arranged in a comparatively small housing. As a result, heat generated from electronic components accumulates in the housing, and this is likely to cause thermal destruction of the electronic components and serious trouble. Therefore at least a venting hole is formed on a wall surface and/or a ceiling surface of a housing of an electronic device, and the heat inside the housing is exhausted from the venting hole to the outside of the housing. Additionally, as a means for exhausting the heat to the outside of the housing actively and cooling the electronic device, it is generally known that an axial flow fan is arranged near the venting hole. It is required that noise of such an axial flow fan for cooling an electronic device is reduced as low as possible, and air flow performance is improved.

An axial flow fan comprises a casing having inlet and outlet, an impeller having a plurality of blades and a motor rotating the impeller. The motor is arranged on a base portion which is connected with a plurality of spokes consisting of linear shape which are integrally formed with the casing and having straight shape.

Additionally, it is known that a plurality of spokes are arranged on the outlet side of a casing, and a cross-sectional shape of the spokes is formed in an airfoil shape or a triangle shape, thereby the spokes work as stationary airfoils. In the event the spokes working as stationary airfoils are arranged on the outlet side of the casing, the spokes can increase the static pressure of air discharged from the outlet, and can rectify the discharged airflow. It is known that all these spokes are formed in a straight shape or in a curved shape. As an axial flow fan having spokes all of which are formed in a curved shape, in Japanese Patent No. 4808482 (hereinafter referred to as the conventional art), an axial flow fan having spokes all of which are formed in a shape convexly curved toward the rotational direction of the impeller is disclosed.

FIG. 6 is a front view of an axial flow fan disclosed in the conventional art. As shown in the FIG. 6, five static blades 102A to 102E are arranged in an outlet 101 of an axial flow blower 100. All of these stationary blades 102A to 102E have a shape convexly curved toward the rotational direction R of the impeller 110, and the stationary blade 102E has a groove portion 104 to accommodate a lead wire 103 for supplying electricity to the motor so as to pull out the lead wire 103 therefrom.

An outlet-side edge portion 105 of the stationary blade 102E is composed of two divided edges 105*a* and 105*b* respectively located at either side of a groove portion 104. Each shape of the two divided edges 105*a* and 105*b* in the vicinity of an internal end portion 106 is inclined so that a flat bottom surface 109 of a bottom wall portion 108 of a motor case and the two divided edges 105*a* and 105*b* are flush with each other.

The conventional art discloses that it becomes easy to insert the lead wire 103 into the groove portion 104 hereby.

However, according to the axial flow fan disclosed in the conventional art, although the two divided edges 105*a* and 105*b*, in the vicinity of the internal end portion 106, are inclined so that the flat bottom surface 109 of the bottom wall portion 108 and the two divided edges 105*a* and 105*b* are flush with each other and hereby it becomes easy to insert the lead wire 103 in the groove portion 104, it is necessary to arrange the lead wire 103 along the curved shape because the stationary blade 102E has a curved shape. Therefore, it is not necessarily easy to arrange the lead wire 103 into the stationary blade 102E and the workability is bad.

SUMMARY OF INVENTION

An axial flow fan according to a first embodiment of the present invention comprises an impeller having a plurality of blades, a motor arranged to rotate the impeller, a casing accommodating the impeller and the motor, and a lead wire for supplying electric power to the motor, wherein the casing comprises a cylindrical housing, a motor base installing the motor, and a plurality of spokes connecting the housing with the motor base, and wherein the plurality of spokes include a spoke having a straight shape and a spoke having a curved shape convexly toward a rotational direction of the impeller.

According to the first embodiment of the present invention, it is preferred that the spoke having the straight shape and the spoke having the curved shape are provided so that when a radial length of the spoke having the straight shape is defined as L and an amount of the curvature of the spoke having the curved shape is defined as X, a displacement of the curved shape (X/L) is less than 0.2. The lead wire is preferably disposed on the spoke having the straight shape. The plurality of spokes preferably include one of the spoke having the straight shape and three of the spokes having the curved shape.

BRIEF DESCRIPTION OF DRAWINGS

FIG. 1 is a cross-sectional view of an axial flow fan of an embodiment of the present invention.

FIG. 2 is a bottom view of the axial flow fan shown in FIG. 1.

FIG. 3 is a graph showing characteristics of the static pressure—air flow in a conventional axial flow fan and an axial flow fan according to an embodiment of the present invention.

FIG. 4 is a view for explaining displacement of a curved shape of a spoke.

FIG. 5 is a graph showing a relationship between a displacement of a curved shape of a spoke and noise.

FIG. 6 is a front view of a conventional axial flow fan.

DESCRIPTION OF EMBODIMENTS

Hereinafter, embodiments of the present invention will be described in detail with reference to the accompanying drawings. Note that, in following description of embodiments of the present invention, words upper, lower, left, right and the like for describing direction and positional relationship between respective members, are relative and not absolute, and merely indicate directions and positional relationships in the drawings. Also note that if each position of the parts of the axial flow fan changes, the direction and positional relationship should be interpreted in response to the positional change.

FIG. 1 and FIG. 2 show an axial flow fan according to an embodiment of the present invention, and FIG. 1 is its cross-sectional view and FIG. 2 is the bottom view of the axial flow fan shown in FIG. 1.

According to FIG. 1 and FIG. 2, the axial flow fan 10 comprises an impeller 13, a motor 14 attaching the impeller 13, a casing 15 accommodating the impeller 13 and the motor 14, and the like. The impeller 13 is provided with a plurality of blades 12 at equal intervals on the outer circumference of a cup-shaped hub 11 which opens to the lower side.

The motor 14 is composed of a rotor 14*a* and a stator 14*b*. The rotor 14*a* comprises a cylindrical rotor yoke 16 made of a magnetic material and secured on the inner circumferential surface of the hub 11, a magnet 17 for rotary drive attached on the inner circumferential surface of the rotor yoke 16, a shaft 18 arranged at the center of the hub 11, and the like. The shaft 18 made of a metal material is integrated with the impeller 13 made of a resin by insert molding.

The casing 15 comprises a cylindrical housing 19, a flange 20, a motor base 21, four spokes 22*a*, 22*b*, 22*c*, 22*d*, and the like, and these portions of the casing 15 are integrally formed with a common thermoplastic resin. The flanges 20 are formed integrally with the housing 19 so that the flanges 20 are extended in four directions at the upper and lower edges of the housing 19. The motor base 21 is disposed opposite to the motor 14 on the bottom edge side of the housing 19 and has a discoid shape. The four spokes 22*a*, 22*b*, 22*c*, 22*d* are connected to the motor base 21 and edge portions of the opening on the bottom side of the housing 19. In the vicinity of each corner portion of the flange 20, a hole 20*a* for inserting a screw, and the like which attaches the axial flow fan 10 to an electronic device.

At the center portion of the motor base 21, a boss portion 21*a* which opens vertically is provided. The lower end of a bearing housing 23 having a cylindrical shape extending upward is fitted to the boss portion 21*a*, and the bearing housing 23 is attached to the motor base 21.

A pair of bearings 24, supporting the shaft 18 rotatably, are attached on the inner circumferential surface of the bearing housing 23 in a state being positioned and fixed vertically. On the other hand, the stator 14*b* is arranged around the outer circumference of the bearing housing 23. The stator 14*b* comprises a stator core 25 formed by stacking silicon steel plates or the like, a coil 27 wound around an insulator 26 attached on the stator core 25, and a printed circuit board 28 disposed on the bottom edge of the insulator 26. The stator core 25 is fitted onto and secured to the outer circumferential surface of the bearing housing 23. The coil 27 is electrically connected to a printed circuit board 28 via a conductive pin 29, and one edge of a lead wire 30 for electrically connecting to an external power source is attached to the printed circuit board 28.

The spokes 22*a*, 22*b*, 22*c*, 22*d* of the motor base 21, as disclosed in FIG. 2, are spaced equally one another in a circumferential direction. The three spokes 22*a*, 22*b*, 22*c* in the four spokes 22*a*, 22*b*, 22*c*, 22*d* have a shape convexly curved toward a rotational direction R of the blades 12 of the impeller 13. In FIG. 2, the rotational direction R is illustrated by sign R and arrow. Only the spoke 22*d* has a straight shape. The lead wire 30 connected to the printed circuit board 28 is attached to the spoke 22*d*, in a state being pulled out from the printed circuit board 28.

The cross-sectional shapes of all spokes including the spokes 22*a*, 22*b*, 22*c* having the curved shape and the spoke 22*d* having the straight shape are formed in an airfoil shape cross-section. Additionally, these airfoil shapes are formed in a same inclination angle (54° in this embodiment), and the spokes 22*a*, 22*b*, 22*c*, 22*d* are formed in the same inclination angle in both inner side and outer side of the radial direction.

A retention member 31 is integrally formed with the spoke 22*d* having the straight shape. The lead wire 30 connected at one end to the printed circuit board 28 is arranged on the retention member 31, and subsequently is inserted and positioned in a retention groove 32 formed in the flange 20, hereby the lead wire 30 is pulled out from the housing 39 to the outside of the housing 19. A stopper plug not illustrated is inserted and fitted into the retention groove 32 to secure the lead wire 30 in the retention groove 32.

According to the axial flow fan 10 constituted hereby, when electricity is supplied from outside to the printed circuit board 28 through the lead wire 30, based on a signal transmitted from a control circuit arranged on the circuit board 28, an excitation current is supplied to the motor 14, and the rotor 14*a* rotates together with the impeller 13.

When the impeller 13 rotates, air flows into the interior of the casing 15 from an inlet 33 of the casing 15. The air flowing into the interior of the casing 15 is introduced in the interior of the casing 15 by the blades 12 and runs through the casing 15.

The pressure of the air which runs through the interior of the casing 15 increases in an outlet 34 side by the spokes 22*a*, 22*b*, 22*c*, 22*d* having the airfoil shape cross-section, and the air is discharged to the outside of the casing 15.

FIG. 3 is a graph showing characteristics of the static pressure—air flow in a conventional axial flow fan and an axial flow fan 10 according to an embodiment of the present invention. In FIG. 3, the vertical axis indicates static pressure P [Pa], and the horizontal axis indicates air flow Q [$m^3$/min]. In the axial flow fan 10 of the embodiment of the present invention and the conventional axial flow fan used in testing the characteristics shown in FIG. 3, both the housing and the impeller are the same structure, but only the shape of the spokes is different between them. That is to say, the axial flow fan 10 has the structure shown in FIG. 1 and FIG. 2, and the three spokes 22*a*, 22*b*, 22*c* in the four spokes 22*a*-22*d* are formed so that the three spokes 22*a*, 22*b*, 22*c* convexly curved toward a rotational direction of the blade 12. Only the spoke 22*d* has a straight shape, and the lead wire 30 is disposed on the spoke 22*d*. On the other hand, the conventional axial flow fan has the structure in which all of the four spokes have a straight shape, and the spoke to which a lead wire is attached has the same straight shape as the spoke 22*d* in the axial flow fan 10 shown in FIG. 1 and FIG. 2 of the embodiment of the present invention.

As shown in FIG. 3, the axial flow fan 10 of an embodiment of the present invention shown by broken line can slightly decrease the static pressure in the lower region of the airflow, while in the middle area and higher region of the airflow, the graph shows the tendency that the axial flow fan 10 slightly increases the static pressure higher than that of the conventional axial flow fan shown by solid line. However, in the static pressure—air flow characteristics shown in FIG. 3, there is little difference between the two air flow characteristics.

FIG. 4 is a view for explaining displacement of a curved shape of three spokes 22*a*, 22*b*, 22*c* which have a shape convexly curved toward a rotational direction of the blade 12. A spoke 22A in FIG. 4 shows a state of a spoke having a straight shape and "the amount of curvature=0". On the other hand, a spoke 22B shows a spoke having a curved shape and the amount of curvature is X which equals to a distance X between the tip and the tip of the pair of white arrows shown in FIG. 4. The ratio of amount of curvature X to the radial length L of the spoke 22A can be represented as a displacement of a curved shape (X/L) of the spoke 22B.

FIG. 5 is a graph showing a relationship between a displacement of a curved shape (X/L) in three spokes 22*a*, 22*b*, 22*c* and noise [dB(A)]. In the test which measured the displacement of the curved shape (X/L) and noise shown in FIG. 5, each of the spokes 22*d* has a straight shape, and each of the impellers has the same shape. Thereby, when the displacement of the curved shape X/L is equal to 0, all of the spokes 22*a*, 22*b*, 22*c*, 22*d* have a straight shape.

As shown in FIG. 5, with increasing displacement of curved shapes of the three spokes 22*a*, 22*b*, 22*c* which are convexly curved toward a rotational direction, noise of the axial flow fan is reduced, but as the displacement of curved shapes become even larger, conversely noise of the axial flow fan tends to increase. Therefore, the displacement of the curved shape (X/L) is preferably set to be less than approximately 0.2. When the displacement of the curved shape (X/L) is set to be less than approximately 0.2, the axial flow fan of the embodiment of the present invention can reduce noise without degrading the air flow characteristics as compared to the conventional axial flow fan in which all spokes have a straight shape.

Therefore, according to the axial flow fan 10 shown in the embodiment of the present invention, in the spokes 22*a*, 22*b*, 22*c*, 22*d* arranged on the outlet 34 side of the casing 15, only the spoke 22*d* on which the lead wire 30 is disposed has the straight shape, and the other spokes 22*a*, 22*b*, 22*c* have the curved shape. Therefore, when the lead wire 30 is pulled out, because there is no need to bend the lead wire 30 and/or to assemble it along the curved shape, the lead wire 30 can pulled out more easily than the conventional axial flow fan in which all the spokes have a curved shape. That is to say, according to the axial flow fan shown in the embodiment of the present invention, because a spoke used to pull out a lead wire for supplying electricity to the motor has a straight shape and the other spokes have a curved shape, the lead wire can be extended straightly along the spoke having the straight shape and can be located easily on the spoke when the lead wire is disposed.

Additionally, as compared to the conventional axial flow fan in which all spokes have a straight shape, the present invention can reduce noise without degrading the air flow characteristics.

The present invention is not limited to the above-described embodiments, and includes changes, modifications, improvements and/or the like of the above-described embodiment within the range that the changes, modifications, improvements and/or the like can achieve the object of the present invention. For example, the embodiment of the present invention includes, but is not limited to the composition arranged the four spokes 22*a*, 22*b*, 22*c*, 22*d* on the outlet 34 side of the casing 15, and it should be sufficient for the present invention to comprise at least three or more spokes in which only the spoke or spokes for securing the lead wire have straight shape.

REFERENCE SIGNS LIST

10 axial flow fan
11 hub
12 blade
13 impeller
14 motor
14*a* rotor
14*b* stator
15 casing
16 rotor yoke
17 magnet for rotary drive
18 shaft
19 housing
20 flange
20*a* hole
21 motor base
21 boss portion
22*a*, 22*b*, 22*c* spoke (curve-shaped)
22*d* spoke (straight-shaped)
22A, 22B spoke
23 bearing housing
24 bearing
25 stator core
26 insulator
27 coil
28 printed circuit board
29 conductive pin
30 lead wire
31 retention member
32 retention groove
33 inlet
34 outlet
R rotational direction

The invention claimed is:

1. An axial flow fan comprising:

an impeller having a hub and a plurality of blades disposed on an outer circumference of the hub;

a motor arranged to rotate the impeller;

a casing accommodating the impeller and the motor, wherein the casing comprises:

a cylindrical housing having upper and lower edges, flanges formed at the upper and lower edges of the cylindrical housing, a motor base configured to hold the motor, the motor base being disposed on a bottom side of the cylindrical housing, and four spokes disposed on an outlet side of the casing, and connecting the motor base and the cylindrical housing, wherein one of the four spokes has a straight shape and the remaining three spokes have a curved shape that is convex toward a rotational direction of the impeller and a lead wire for supplying electric power to the motor disposed on the spoke having the straight shape, wherein:

when viewed from the outlet side of the casing, the flange at the lower edge of the cylindrical housing has a tetragonal outer periphery and has an inner periphery that has four arc-shaped corners connected by four linear sides;

each of the four spokes is coupled to one of the arc-shaped corners of the flange at the lower edge of the cylindrical housing; and the spoke having the straight shape and the spokes having the curved shape are provided so that when a radial length of the spoke having the straight shape is defined as L and an amount of the curvature of the spokes having the curved shape is defined as X, a displacement of the curved shape (X/L) is more than 0 and less than 0.2.

2. The axial flow fan according to claim 1, wherein the cylindrical housing forms an outer periphery of the casing.

3. The axial flow fan according to claim 1, wherein the plurality of blades are arranged so as not to overlap with each other in an axial direction.

* * * * *